US010220499B2

(12) United States Patent
Lam et al.

(10) Patent No.: US 10,220,499 B2
(45) Date of Patent: Mar. 5, 2019

(54) POWER TOOL

(71) Applicant: Techtronic Power Tools Technology Limited, Tortola (VG)

(72) Inventors: Chin Hung Lam, Tsuen Wan (HK); Tsz Kin Wong, Tsuen Wan (HK)

(73) Assignee: TECHTRONIC POWER TOOLS TECHNOLOGY LIMITED, Tortola (VG)

( * ) Notice: Subject to any disclaimer, the term of this patent is extended or adjusted under 35 U.S.C. 154(b) by 907 days.

(21) Appl. No.: 13/956,546

(22) Filed: Aug. 1, 2013

(65) Prior Publication Data

US 2014/0034347 A1 Feb. 6, 2014

(30) Foreign Application Priority Data

Aug. 1, 2012 (CN) ..... 2012 2 0379936 U

(51) Int. Cl.
*B25B 21/00* (2006.01)
*B25F 5/00* (2006.01)
*B25B 23/147* (2006.01)

(52) U.S. Cl.
CPC ..... *B25F 5/00* (2013.01); *B25B 21/00* (2013.01); *B25B 23/147* (2013.01); *B25F 5/001* (2013.01); *B25B 21/008* (2013.01)

(58) Field of Classification Search
CPC ..... B23Q 11/04; B25B 23/14; B25B 23/147; B25B 23/1475; B25F 5/001; G01L 25/003
USPC ..... 173/180, 5, 6, 176, 181, 182, 183; 73/1.09, 862.325, 862.328, 862.23
See application file for complete search history.

(56) References Cited

U.S. PATENT DOCUMENTS 5,172,774 A * 12/1992 Melrose ..... G01L 3/108 173/182
5,182,953 A * 2/1993 Ellinger ..... G01L 3/12 324/244.1
5,440,215 A * 8/1995 Gilmore ..... B23P 19/066 173/178
5,456,123 A * 10/1995 Parkinson ..... G01L 3/12 73/1.09
7,314,097 B2 * 1/2008 Jenner ..... B25B 21/00 173/178
7,717,192 B2 * 5/2010 Schroeder ..... B25D 16/006 173/104
2008/0135269 A1 * 6/2008 Friberg ..... B25B 23/1456 173/93.5
2009/0255700 A1 * 10/2009 Lehnert ..... B25B 23/1405 173/104
2011/0220377 A1 * 9/2011 Roehm ..... B25B 21/00 173/47

(Continued)

FOREIGN PATENT DOCUMENTS

CN 202779907 3/2013
DE 3103286 8/1982

*Primary Examiner* — Chelsea E Stinson
(74) *Attorney, Agent, or Firm* — Michael Best & Freidrich LLP

(57) ABSTRACT

A power tool has an electric motor driving a spindle and a rotary encoder for setting a torque limit. A control circuit is operatively connected to the rotary encoder for interrupting power supply to the motor when the torque limit has been reached. An actuator sleeve mounted to rotate about the spindle, and a detent holds the sleeve in a plurality of angular positions corresponding to positions of the contacts.

25 Claims, 7 Drawing Sheets

(56) References Cited

U.S. PATENT DOCUMENTS

2013/0192860 A1* 8/2013 Puzio ..... B25F 5/00
173/47

* cited by examiner

| Angular Position | Contact Track Lengths | | | | |
|---|---|---|---|---|---|
| | 133a | 133b | 133c | 133d | 133e |
| 1 | X | | | | |
| 2 | X | X | | | |
| 3 | X | X | | X | |
| 4 | X | X | | X | |
| 5 | | X | | X | |
| 6 | | X | X | X | |
| 7 | | X | X | X | X |
| 8 | | X | X | | X |
| 9 | | | X | | X |
| 10 | | | X | X | X |
| 11 | X | | X | X | X |
| 12 | X | | X | X | |
| 13 | X | | | X | |
| 14 | | | | X | X |
| 15 | X | X | | X | X |
| 16 | | X | | X | X |
| 17 | | X | | | X |
| 18 | X | X | | | X |
| 19 | X | X | X | | X |
| 20 | X | | X | | X |

POWER TOOL

CROSS-REFERENCE TO RELATED APPLICATION

This application claims priority to Chinese Patent Application No. 201220379936.6, filed on Aug. 1, 2012, the entire contents of which are incorporated by reference herein.

BACKGROUND

The present invention relates generally to power hand tools such as drivers for applying torque to a fastener, or drills for use with rotary cutting tools, in which the output torque is user-adjustable.

It is known to provide power tools with a mode-selector that the operator uses to change between a driver mode in which a torque limit may be selected for driving fasteners, and a drill mode in which no torque limit is set. The mode selector may simultaneously change between a high-torque, low-speed operation in the driver mode, to low-torque, high-speed in the drill mode, as by connection of the mode selector to a speed-change gearbox.

In a commonly available tool, a torque limiting clutch is used and, by varying the pre-load on a clutch spring, the torque at which the driving member slips relative to the driven member is controlled. A control sleeve may be mounted about the spindle at one end the tool housing (for instance, adjacent the chuck) for making the torque selection. Such an arrangement is ergonomically advantageous, as the tool can be supported for use and for rotation of the sleeve generally about the spindle axis to vary the torque selection, without the need loosen a grip on the tool. The clutch is disposed between the gearbox and the output end of the spindle, of the chuck, so one disadvantage of this arrangement is that it extends the axial dimension of the tool. It will be understood, therefore, that there is a need for a tool which is relatively more compact, allowing for use in tighter spaces.

As an alternative to a clutch in a power tool, it is known for instance in tools like that described in DE3103286, to employ a potentiometer by which a torque limit value can be set. In such tools, a control circuit includes a switching element for controlling current flow to the motor, and which compares the level the current consumed by the motor with a current value set by means of the potentiometer. In operation when the current drawn by the motor reaches the value set by the potentiometer, and thus the selected maximum value of the torque, the switching means cuts power to the motor. However, to date there remains an unmet need for a compact power tool with an ergonomically efficient arrangement that allows the power tool to be manufactured cost effectively. It is an object of the present invention to address these needs or, more generally, to provide an improved power tool.

SUMMARY

According to one aspect of the present invention, there is provided a power tool comprising an electric motor for driving a spindle, an actuator sleeve mounted to rotate about the spindle, a rotary encoder that converts the angular position of the actuator sleeve to an output defining a torque limit, and a control circuit operatively connected to the rotary encoder for interrupting power supply to the motor when the torque limit has been reached.

The power tool may further comprise a detent for holding the actuator sleeve in a plurality of pre-defined angular positions, each corresponding to a respective torque limit.

It will be understood that the rotary encoder may be implemented by a variety of technologies. Contact-type rotary encoder technologies may include circumferentially spaced contacts or conductive tracks and wipers for engaging the contacts or tracks. Non-contact type technologies may include optical and magnetic angular position encoders.

The sleeve may be formed of opaque material and a plurality of windows are disposed circumferentially spaced apart in the sleeve, and an indicator lamp is disposed inside the sleeve for registration with one of the windows at each of the angular positions.

The sleeve comprises an inner axial end adjacent a housing of the tool, and the windows comprise notches formed in the inner axial end. The sleeve further comprises a light pipe of translucent material, the light pipe having an annular portion at least partly entering into the inner axial end, and a plurality of blocks projecting substantially radially and each fixed to the annular portion and received in a respective notch.

The actuator sleeve is axially located between a mounting and a retaining ring extending about the spindle. The actuator sleeve has an internal shoulder against which the retaining ring engages such that the retaining ring is enclosed within the axial extent of the actuator sleeve. The detent comprises recesses in a circumferential array and a latching portion resiliently urged into the recesses, the recesses and latching portion being disposed on a respective one of the retaining ring and the sleeve. The latching portion is a portion of a leaf spring. The latching portion is a convex portion disposed in an intermediate part of the leaf spring between two opposing ends by which ends the leaf spring is mounted.

The mode change actuator is disposed adjacent the actuator sleeve, and the mode change actuator rotates substantially about the spindle axis between a driver position in which the potentiometer sets a torque limit of the spindle, and a drill position.

The rotary encoder comprises a disc extending about the spindle, a circumferential array of electrical contacts disposed on the disc and a wiper for engaging the contacts, wherein one of the disc and wiper is stationary and the other of the disc and wiper is fixed to rotate with the actuator sleeve.

The electrical contacts comprise elongate arcuate concentric track lengths disposed in a pattern, and the wiper comprises a plurality of contact points, such that each of the pre-defined angular positions has a respective unique binary code in which some of the contact points abut track lengths and others do not.

The wiper comprises a ring-shaped conductor and the contact points are formed on arms integral with the wiper, the arms comprising first and second sets of arms, the disc further comprising an annular track concentric with the track lengths, the arms of the first set being disposed for engaging the annular track, the arms of the second set being disposed for engaging the concentric track lengths.

Each of the contacts of the circumferential array is associated with a respective one of the plurality of pre-defined angular positions, and wherein resistors connect the contacts so as to provide a plurality of discrete resistances.

The disc comprises a conductive penannular track disposed adjacent the array of electrical contacts, and the wiper is configured to span between and connect the track and one the electrical contacts in the annular positions. The wiper comprises a base part to which first and second arms are mounted in a cantilever manner, the first arm abutting the electrical contacts and the second arm abutting the penannular track.

The disc has axially opposing first and second faces and the electrical contacts and penannular track are disposed on the first face.

The resistive means comprises a plurality of resistors of different resistances. Alternatively, for instance, the resistive means comprises an electrical string in which a plurality of resistors of the same resistance are electrically connected in series with the electrical contacts.

The resistors project from the second face, and the disc comprises a printed circuit board.

A pair of terminals are provided on the disc for providing the electrical input and output, switching means connected between the pair of terminals and actuable by a mode change actuator to short-circuit the resistive means. Disc is connected to the mount, and the wiper is connected to the actuator sleeve.

The rotary encoder comprises: a disc extending about the spindle, disc having transparent and opaque areas; at least one emitter and detector pair, the emitter being disposed on an opposite side of the disc to the detector, wherein one of the emitter and detector pair and the disc is stationary and the other of the emitter and detector pair and the disc is fixed to rotate with the actuator sleeve, and wherein each of the pre-defined angular positions has a respective optical pattern.

This invention provides a power which is ergonomically efficient, where the controls are conveniently positioned with regard to the manner in which the tools is held, and which provides a compact tool, able to be used in confined spaces. Moreover, the tool has an overall simple design which minimizes manufacturing costs.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being praticed or of being carried out in various ways. Also, it is to be understood that the phraseology and terminology used herein is for the purpose of description and should be be regarded as limiting.

DETAILED DESCRIPTION

Figure 1:
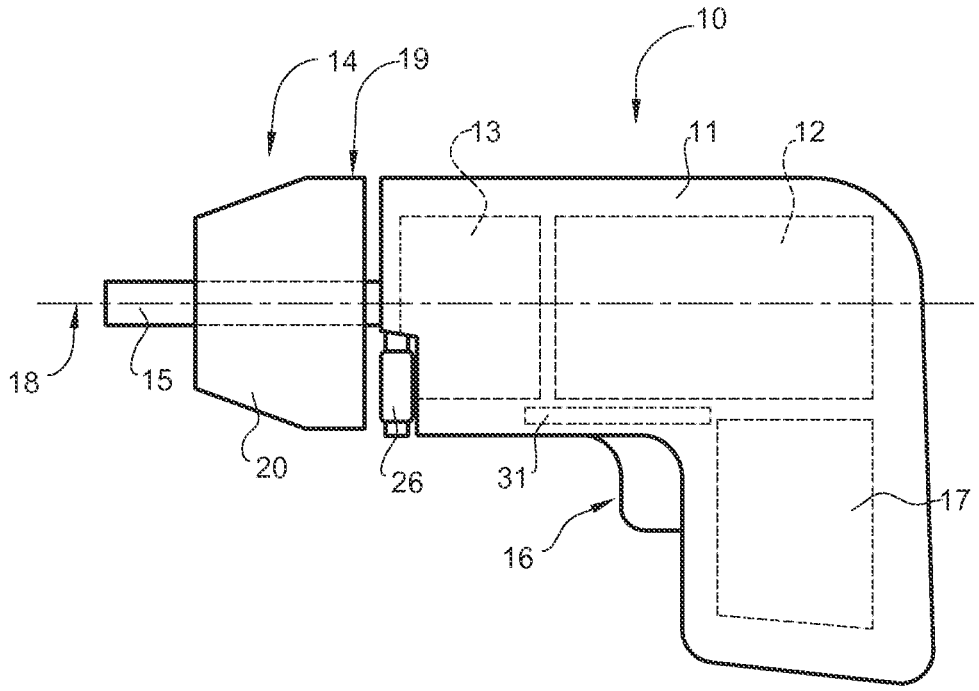
FIG. 1 is a schematic side view of a power tool according to the invention.

With reference to FIG. 1, a power tool 10 constructed in accordance with the teachings of the invention, may be a mains-powered or a cordless (battery operated) hand-held device, such as a driver or drill. In the particular embodiment illustrated, power tool 10 may be a cordless drill having a housing 11, a motor assembly 12, a multi-speed gear assembly 13, a front sleeve assembly 14, an output spindle 15, a trigger 16, a control circuit 31 and a battery pack 17. The spindle 15 may be fixed to a chuck (not shown) and has an axis of rotation 18. As used herein, the term "axial" refers to a direction substantially parallel to the axis 18. The term "radial" refers to a direction substantially orthogonal to the axis 18. The term "circumferential" refers to the direction of a circular arc having a radius substantially orthogonal to the axis 18. The spindle 15 extends axially through the front sleeve assembly 14. The front sleeve assembly 14 includes an actuator sleeve 20 mounted to rotate about the spindle 15, with an inner end 19 adjacent the housing 11.

Figure 2:
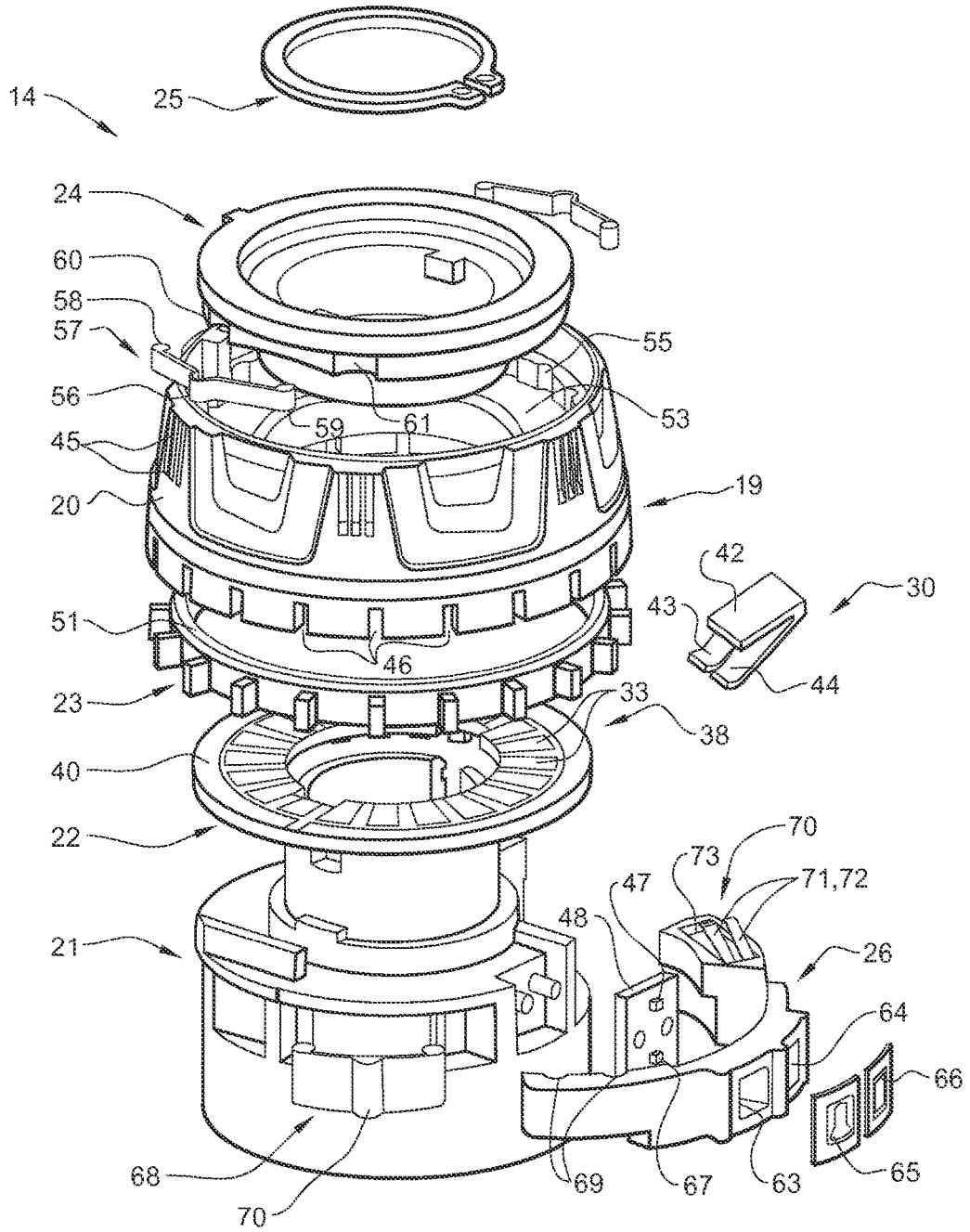
FIG. 2 is an exploded view of a first embodiment of a front sleeve assembly of the tool of FIG. 1.

FIGS. 2 to 5 illustrate in more detail a first embodiment of the invention incorporating a contact-type rotary encoder. FIG. 2 illustrates in more detail the construction of the front sleeve assembly 14 which, in addition to the actuator sleeve 20, generally further includes a mount 21, a disc 22, a light pipe 23, a retaining ring 24 and a fastener 25.

The mount 21 serves to support the actuator sleeve 20 for rotation about the axis 18 and may be fixed to the housing 12 and also serve to enclose the gear assembly 13. Cooperating stop faces on the actuator sleeve 20 and mount 21 may prevent the actuator sleeve 20 from making a complete rotation.

A mode change operator 26 is a switch element moveable between a driver position in which the actuator sleeve 20 may be used to set an output torque limit for driving fasteners and a drilling position in which no torque limit is set, and it may also be secured to the mount 21.

A feature of the invention is the incorporation into the front sleeve assembly 14 of a rotary encoder connected to the control circuit 31 and used for setting the torque limit. In particular, the invention allows this to be achieved with a compact and ergonomically efficient arrangement, and also one that allows the power tool to be manufactured cost effectively. The control circuit 31 includes a switching element (not shown) for controlling current flow to the motor 12, and with the mode change operator 26 in the driver position the control circuit 31 compares the level the current consumed by the motor, which increases in proportion to the torque of the spindle 15, with a current value that can be set selected by means of the rotary encoder. Therefore when the current drawn by the motor reaches the value set by the rotary encoder, and thus the selected maximum value of the torque, the switching means is operated to interrupt the current supply to the drive motor and turn off the power tool.

The rotary encoder has a small dimension in the axial direction, allowing for a reduction in the axial dimension of the tool. The rotary encoder comprises the disc 22 and a wiper 30. The disc 22 generally lies in a plane transverse to the axis 18, with the spindle extending axially through the disc. In the preferred embodiments illustrated the disc 22 is connected to the mount 21 and the wiper 30 is connected to the actuator sleeve 20 (but it will be understood that this is not essential to the invention, only that there should be relative movement between the disc 22 and wiper 30). The disc 22 is mounted coaxial with axis 18 and may have an outer face 38 (visible in FIG. 2) on which a circumferential array of electrical contacts 33 are disposed (twenty contacts 33 being illustrated in FIG. 2). Projecting from the opposing inner face 39 of the disc 22 are resistors 35. Each of the resistors 35 may have a different resistance value, providing discrete resistance steps. Each of the resistors 35 may be connected to only a respective one of the contacts 33. The disc may further comprise a conductive penannular track 40 substantially coaxial with axis 18 and disposed on outer face 38 adjacent the array of electrical contacts 33 and, for instance, located radially outside the array of electrical contacts 33. On the inner face 39, a pair of spaced apart electrical connections 75, 76 is provided.

The wiper 30 is configured to span between and connect the track 40 and one the electrical contacts 33 in the annular positions. The wiper 30 comprises a base part 42 fastened to the actuator sleeve 20, and first and second arms 43, 44 that extend in a cantilever manner, the first arm 43 abutting the electrical contacts 33 and the second arm 44 abutting the penannular track 40. The rotary encoder thus provides a voltage divider like a rotary potentiometer but preferably, as shown, with discrete resistance steps between angular positions.

The actuator sleeve 20 may be formed of opaque material, as by moulding, with features 45 such as depressions to assist in gripping the actuator sleeve 20. A plurality of windows 46 are shown circumferentially spaced apart in the actuator sleeve 20, and may be formed by notches in the inner axial end 19. A first indicator lamp 47, such as an LED, may be mounted to a plate 48 which is in turn fastened to the mount 21. The lamp 47 is positioned for registration with the windows 46 at each of the angular positions, and is operated when the mode change operator 26 is in the driver position, providing an indication to the user of the mode and the torque setting according to the position of the actuator sleeve 20.

The light pipe 23 is formed of translucent material and may be fixed to the actuator sleeve 20. The light pipe 23 may have an annular portion 51 so as to present a concave face toward the lamp 47, the annular portion 51 at least partly entering into the inner axial end 19, and a plurality of blocks 52 projecting substantially radially and each fixed to the annular portion 51. The blocks 52 are complementary to the windows 46, in which they are received.

The actuator sleeve 20 is axially located between the mount 21 and the retaining ring 24 which also extends about the spindle 15. The actuator sleeve 20 has an internal shoulder 53 against which the retaining ring 24 engages such that the retaining ring 24 is enclosed within the axial extent of the actuator sleeve 20. The fastener 25 may be a C-ring received in a groove (not shown) in the mount 21 to secure the retaining ring 24. A detent comprises recesses 55 in a circumferential array inside the actuator sleeve 20 and a latching portion 56 resiliently urged into the recesses 56. The positions of the recesses 55 defining the angular positions, in which the arm 43 engages one of the contacts 33, and a corresponding one of the windows 46 is aligned with the lamp 47. The latching portion 56 may be a portion of a leaf-type detent spring 57, particularly a convex portion disposed in an intermediate part of the detent spring 57 between two opposing ends 58, 59. The ends 58, 59 of the detent spring 57 may be received in respective concavities in the retaining ring 24, by which ends the detent spring 57 is located. Two leaf springs 57 may be provided, mounted to diametrically opposing sides of the retaining ring 24.

The mode change operator 26 is supported between the mount 21 and the housing 12 for movement between the driver and drill positions. The mode change operator 26 may include a concave surfaces centred on the axis 18, for engagement with a complementary surface on the mount 21. It includes two adjacent openings 63, 64 covered by respective transparent mode indicia 65, 66. A second lamp 67 may be mounted to the board 48, and may have a visual signature distinct from that of first lamp 47, such as a different colour, for indicating the drill mode. A latching spring 68 with a convex latching portion 70 may be located on the mount 21, for urging the latching portion 70 into adjacent recesses 69 in the mode change operator 26 thus providing a detent action in the driver and drill positions. A contactor 70 fixed in a recess in the mode change operator 26 is an electrical switch element of like construction to the wiper 30, having a pair of contactor arms 71, 72 that extend in a cantilever manner from a base part 73 the arms being urged toward the inner face 39 of the disc 22.

Figure 3:
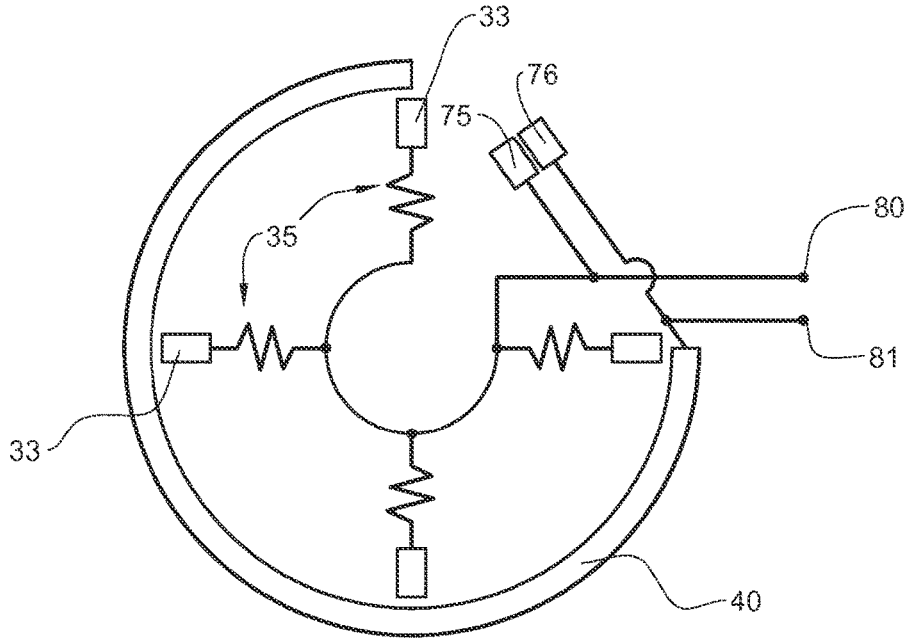
FIG. 3 is an electrical schematic of a rotary encoder of the tool of FIG. 2.
Figure 4:
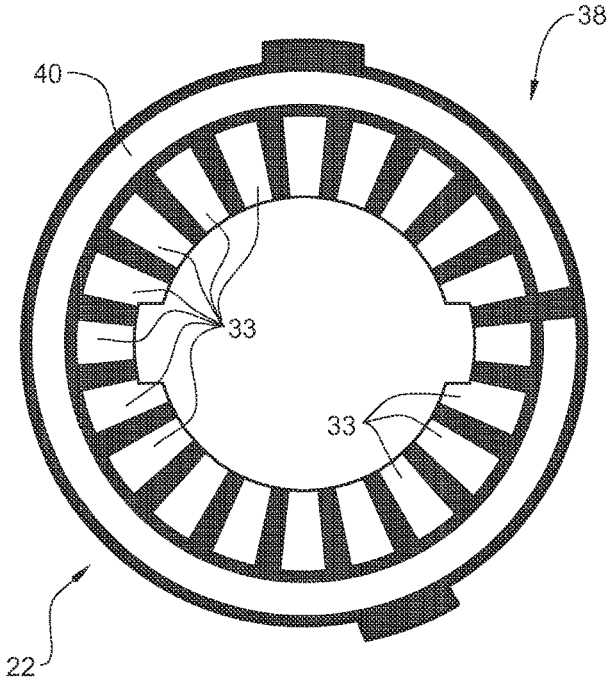
FIGS. 4 and 5 show outer and inner sides, respectively, of a disc of the tool of FIG. 2.
Figure 5:
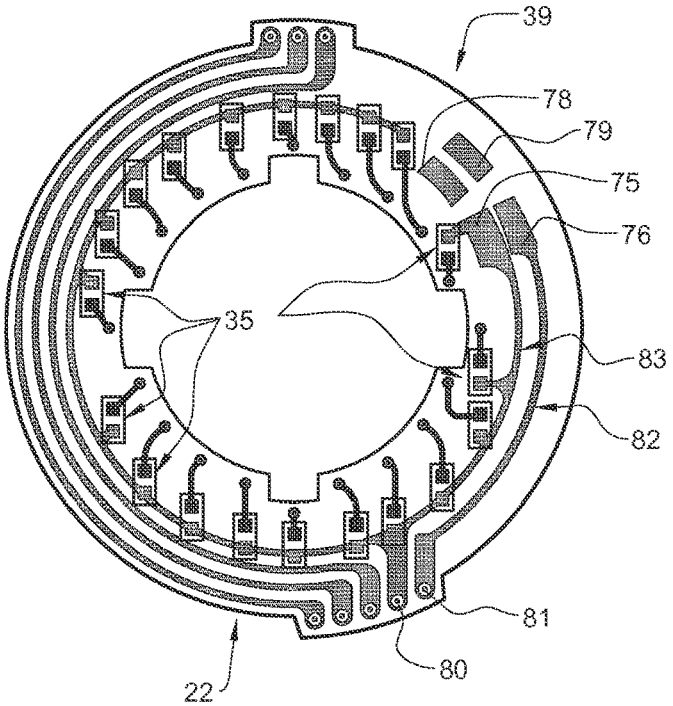

FIG. 3 schematically illustrates the operation of the rotary encoder which has terminals 80, 81 on the disc 22. Terminal 81 may be connected to the electrical connection 76 by an arcuate, circumferentially elongated track 82. An adjacent penannular track 82 may be connected to each of the resistors 35, the terminal 80 and the electrical connection 75.

By moving the mode change operator 26 to the driver position, the mode is indicated to the user by the illumination of the driver mode indicator 65. In this position the contactor arms 71, 72 of the contactor 70 may abut dummy contacts 78, 79 which are not connected together, or connected in the circuit. In this driver mode, by turning the actuator sleeve 20 the wiper 30 is moved, and while the wiper arm 44 maintains contact with the track 40 the other wiper arm 43 is moveable between detent positions in which it engages one of the contacts 35, and so electrically connects an associated one of the resistors 35 between the terminals 80, 81. When the current drawn by the motor reaches the value set by the engaged one of the resistors 35, the switching means is operated to interrupt the current supply to the motor and turn off the power tool. Moving the mode change operator 26 to the drilling position the contactor arms 71, 72 of the contactor 70 are moved to abut the electrical connections 75, 76, allowing current to pass between the electrical connections 75, 76 and thus the contactor 70 directly between the terminals 80, 81, short-circuiting the rotary encoder and disabling its torque setting function.

Figure 6:
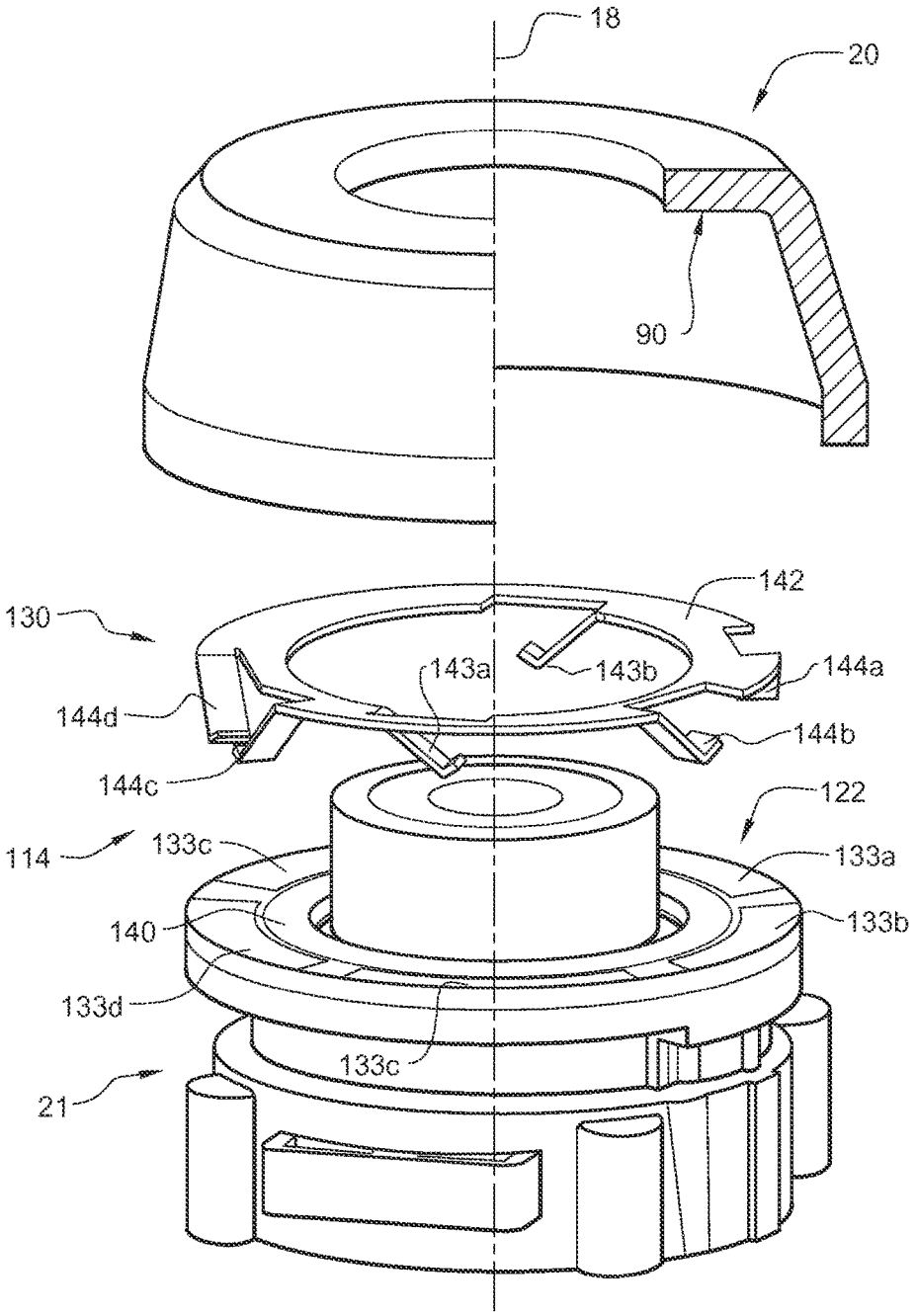
FIG. 6 is an exploded view of the front sleeve assembly of a second embodiment of a power tool of the invention.
Figures 7, 8:
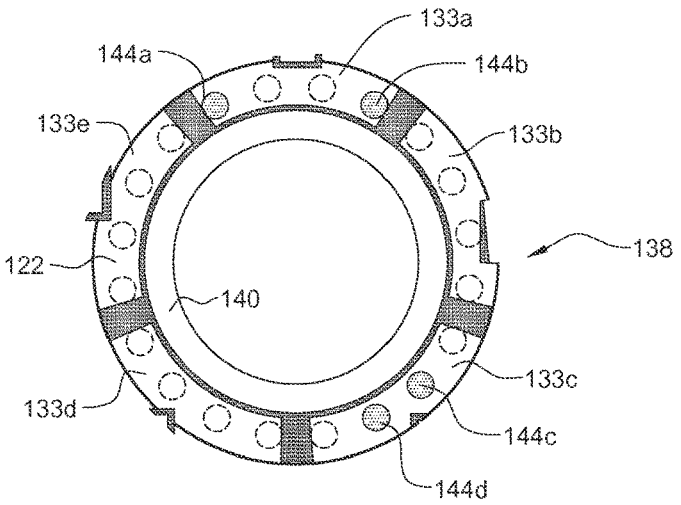
FIG. 7 is a schematic view of the disc of the front sleeve assembly of FIG. 6.
FIG. 8 is a table showing unique binary code associated with each angular position of the sleeve.

FIGS. 6 to 8 illustrate a second embodiment of the invention incorporating in the front sleeve assembly 114 a contact-type rotary encoder disposed within the actuator sleeve 20, and also providing an ergonomically advantageous and compact device for setting the torque limit of the tool. The rotary encoder comprises the disc 122 extending about the spindle 15 and a wiper 130 which may be formed of a ring-shaped conductor. On the outer face 138 of the disc 122 the electrical contacts comprise elongate arcuate track lengths 133*a*-133*e* disposed in a pattern in which they are concentric and circumferentially spaced apart. The disc 122 may further comprise a conductive annular track 140 substantially coaxial with axis 18 and disposed on outer face 138 adjacent the array of contact track lengths 133*a*-133*e* and, for instance, located radially inside the array of track lengths 133*a*-133*e*.

The wiper 130 is configured to span between and connect the track 140 and different combinations of the contact track lengths 133*a*-133*e*. The wiper 130 comprises a base ring 142 fastened to the actuator sleeve 20, and, for instance, abutting an internal annular face 90 of the sleeve 20. The wiper 130 has first and second arms 143*a*, 143*b* that extend in a cantilever manner and which are disposed at the same radial distance from the axis 18 so as to abut the annular track 140. Arms 144*a*-144*d* of like form are disposed about the outer periphery of the base ring 142 for engagement with the contact track lengths 133*a*-133*e*.

FIG. 7 schematically illustrates the operation of the rotary encoder, wherein each of the twenty angular positions of the sleeve 20 are represented by one circle in the array of circles shown in dashed lines overlying the track lengths 133*a*-133*e*. Each one of the arms 144*a*-144*d* is located by the detent in one of the twenty positions. The annular track 140 may be connected to a current source and each of the track lengths 133*a*-133*e* to a respective electrical sensor in the control circuit. Each of the arms 144*a*-144*d* defines a contact point, such that each of the pre-defined angular positions has a respective unique binary code in which some of the contact points abut track lengths and others do not. In each of the angular positions, each of the track lengths 133*a*-133*e* is either connected to the current source (indicated by "X" in FIG. 8) or it is not (indicated by a blank cell in FIG. 8). In FIG. 7 the sleeve 20 is in the angular position designated by number "1" in the first row of the table shown in FIG. 8. To reach the angular positions numbered 2 to 20 in the following rows in FIG. 8 the arms 144*a*-144*d* are rotated clockwise with reference to FIG. 7 by 1 to 19 steps. As FIG. 8 illustrates, each of the twenty angular positions produces a respective binary code which may be associated (as I a look-up table) with a respective motor current threshold and therefore torque setting which, when reached results in the control circuit stopping the motor.

Figure 9:
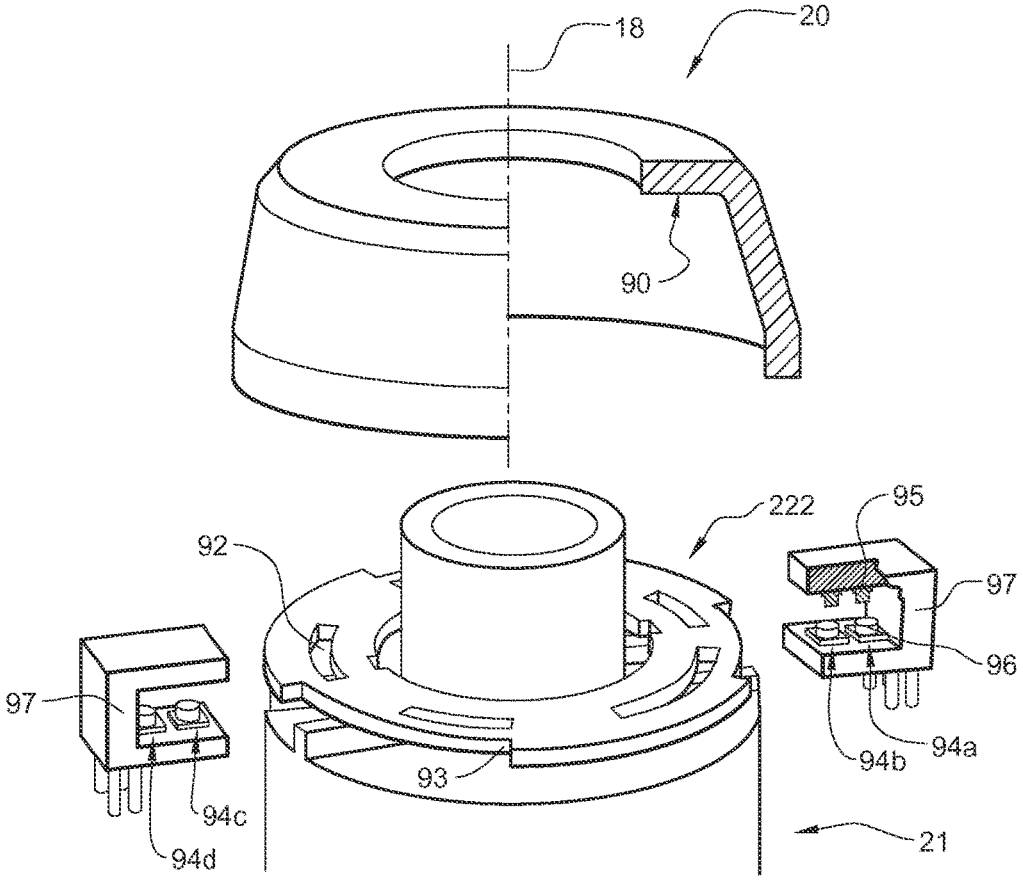
FIG. 9 is an exploded view of the front sleeve assembly of a third embodiment of a power tool of the invention.

A non-contact rotary encoder may also be disposed within the actuator sleeve 20, as shown in FIG. 9, which illustrates an optical rotary encoder which produces a unique digital code for each distinct angular position of the sleeve 20. The rotary encoder comprises a disc 222 extending about the spindle, and formed of opaque material having transparent window areas formed as by circumferentially extending slots 92 or recesses 93 in the periphery of the disc 222. For cooperating with the disc 222, four emitter and detector pairs 94*a*-94*d* may be provided. Each of the pairs 94*a*-94*d* comprises an emitter 95 and adjacent receiver 96, the emitter 95 being disposed on an opposite side of the disc 222 to the detector 96. In the embodiment shown, two emitter and detector pairs 94*a*/94*b*, 94*c*/94*d* are mounted to respective channel-shaped holders 97 which may be fixed to the mount 21 diametrically opposite one another, such that they are stationary. The disc 222 is fixed to rotate with the sleeve 20, thereby providing the requisite relative rotation between the emitter and detector pairs and the disc 222. The pattern of transparent window areas 92, 93 is arranged such that each of the pre-defined angular positions has a respective optical pattern.

Aspects of the invention have been described by way of example only and it should be appreciated that modifications and additions may be made thereto without departing from the scope thereof. Various features of the invention are set forth in the following claims.

The invention claimed is:

1. A power tool comprising:

a housing;

an electric motor for driving a spindle and positioned inside the housing;

an actuator sleeve outside the housing that is rotatable about the spindle to set a torque limit, wherein a mode change actuator is disposed adjacent the actuator sleeve;

a rotary encoder separate from the actuator sleeve that converts the angular position of the actuator sleeve to an output defining the torque limit, and a control circuit operatively connected to the rotary encoder for interrupting power supply to the motor when the torque limit has been reached.

2. The power tool of claim 1 further comprising a detent for holding the actuator sleeve in a plurality of pre-defined angular positions, each corresponding to a respective torque limit.

3. The power tool of claim 2 wherein the sleeve is formed of opaque material and a plurality of windows are disposed circumferentially spaced apart in the sleeve, and an indicator lamp is disposed inside the sleeve for registration with one of the windows at each of the angular positions.

4. The power tool of claim 3 wherein the sleeve comprises an inner axial end adjacent a housing of the tool, and the windows comprise notches formed in the inner axial end.

5. The power tool of claim 4 wherein the sleeve further comprises a light pipe of translucent material, the light pipe having an annular portion at least partly entering into the inner axial end, and a plurality of blocks projecting substantially radially and each fixed to the annular portion and received in a respective notch.

6. The power tool of claim 2 wherein the actuator sleeve is axially located between a mounting and a retaining ring extending about the spindle.

7. The power tool of claim 6 wherein the actuator sleeve has an internal shoulder against which the retaining ring engages such that the retaining ring is enclosed within the axial extent of the actuator sleeve.

8. The power tool of claim 6 wherein the detent comprises recesses in a circumferential array and a latching portion resiliently urged into the recesses, the recesses and latching portion being disposed on a respective one of the retaining ring and the actuator sleeve.

9. The power tool of claim 8 wherein the latching portion is a portion of a leaf spring.

10. The power tool of claim 9 wherein the latching portion is a convex portion disposed in an intermediate part of the leaf spring between two opposing ends by which ends the leaf spring is mounted.

11. The power tool of claim 1 wherein the mode change actuator rotates substantially about the spindle axis between a driver position in which a potentiometer sets a torque limit of the spindle, and a drill position.

12. A power tool comprising:

a housing;

an electric motor for driving a spindle and positioned inside the housing;

an actuator sleeve outside the housing that is rotatable about the spindle to set a torque limit;

a rotary encoder separate from the actuator sleeve that converts the angular position of the actuator sleeve to an output defining the torque limit, and a control circuit operatively connected to the rotary encoder for interrupting power supply to the motor when the torque limit has been reached, wherein the rotary encoder comprises a disc extending about the spindle, a circumferential array of electrical contacts disposed on the disc and a wiper for engaging the contacts, wherein one of the disc and wiper is stationary and the other of the disc and wiper is fixed to rotate with the actuator sleeve.

13. The power tool of claim 12 wherein the electrical contacts comprise elongate arcuate concentric track lengths disposed in a pattern, and the wiper comprises a plurality of contact points, such that each of the pre-defined angular positions has a respective unique binary code in which some of the contact points abut track lengths and others do not.

14. The power tool of claim 13 wherein the wiper comprises a ring-shaped conductor and the contact points are formed on arms integral with the wiper, the arms comprising first and second sets of arms, the disc further comprising an annular track concentric with the track lengths, the arms of the first set being disposed for engaging the annular track, the arms of the second set being disposed for engaging the concentric track lengths.

15. The power tool of claim 12 wherein each of the contacts of the circumferential array is associated with a respective one of a plurality of pre-defined angular positions, and wherein a plurality of resistive means connect the contacts so as to provide a plurality of discrete resistances.

16. The power tool of claim 15 wherein the disc comprises a conductive penannular track disposed adjacent the array of electrical contacts, and the wiper is configured to span between and connect the track and one the electrical contacts in the annular positions.

17. The power tool of claim 16 wherein the wiper comprises a base part to which first and second arms are mounted in a cantilever manner, the first arm abutting the electrical contacts and the second arm abutting the penannular track.

18. The power tool of claim 16 wherein the disc has axially opposing first and second faces and the electrical contacts and penannular track are disposed on the first face.

19. The power tool of claim 17 wherein the disc has axially opposing first and second faces and the electrical contacts and penannular track are disposed on the first face.

20. The power tool of claim 15 wherein the plurality of resistive means comprises a plurality of resistors of different resistances.

21. The power tool of claim 19 wherein the resistors project from the second face.

22. The power tool of claim 12 wherein the disc comprises a printed circuit board.

23. The power tool of claim 12 wherein a pair of terminals are provided on the disc for providing the electrical input and output, a plurality of switching means connected between the pair of terminals and actuable by a mode change actuator to short-circuit the resistive means.

24. The power tool of claim 22 wherein disc is connected to a mount, and the wiper is connected to the actuator sleeve.

25. The power tool of claim 1 wherein the rotary encoder comprises: a disc extending about the spindle, disc having transparent and opaque areas; at least one emitter and detector pair, the emitter being disposed on an opposite side of the disc to the detector, wherein one of the emitter and detector pair and the disc is stationary and the other of the emitter and detector pair and the disc is fixed to rotate with the actuator sleeve, and wherein each of the pre-defined angular positions has a respective optical pattern.

* * * * *